US007987592B2

(12) United States Patent
Good et al.

(10) Patent No.: US 7,987,592 B2
(45) Date of Patent: Aug. 2, 2011

(54) SPIRAL HEATER WIRE TERMINATION

(75) Inventors: Robert Scott Good, Camp Hill, PA (US); Daniel E. Stahl, Middletown, PA (US); David F. Fleming, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 380 days.

(21) Appl. No.: 11/752,597

(22) Filed: May 23, 2007

(65) Prior Publication Data

US 2008/0289874 A1 Nov. 27, 2008

(51) Int. Cl.
*H01R 43/00* (2006.01)

(52) U.S. Cl. ..... 29/857; 29/854; 29/861; 29/882; 29/751; 29/753; 439/578; 439/585; 439/880; 439/882; 439/878; 219/247

(58) Field of Classification Search ..... 439/207, 439/208, 210, 211, 449, 512, 578; 29/857, 29/861, 854, 876, 882, 748, 751, 753, 761; 219/247

See application file for complete search history.

(56) References Cited

U.S. PATENT DOCUMENTS 3,648,224 A * 3/1972 McDonough ..... 439/585
5,206,485 A * 4/1993 Srubas et al. ..... 219/549

* cited by examiner

*Primary Examiner* — Derris H Banks
*Assistant Examiner* — Azm Parvez

(57) ABSTRACT

An electrical connector for use with providing an electrical termination to an end of a cable having a conductor helically disposed between a core and a layer overlying the core. The connector includes a first portion having an opening sized greater than a diameter defined by the helically disposed conductor but less than a diameter of the layer. A second portion has an opening sized greater than a diameter defined by the helically disposed conductor. A third portion is configured to receive a conductor of a second cable. As a result of the end of the cable being sufficiently inserted through the opening of the first portion, the helically disposed conductor is exposed about a length of the cable extending through another side of the first portion and received in the opening of the second portion.

9 Claims, 5 Drawing Sheets

SPIRAL HEATER WIRE TERMINATION

FIELD OF THE INVENTION

The present invention relates generally to cables and, more particularly, to devices for use with cables capable of producing thermal energy in response to electrical energy applied to wires disposed in the cables.

BACKGROUND OF THE INVENTION

It is desirable to provide thermal energy to locations not easily accessible to a furnace, or conventional heat source. For example, one application is directed to water lines disposed adjacent to outer walls of structures exposed to frigid temperatures capable of freezing the water in the lines, possibly bursting the lines. A solution is to secure a cable containing a wire disposed in the cable that produces thermal energy in response to electrical energy applied to the wire. FIG. 1 shows an embodiment of a cable 10 that contains a fiberglass core 12 with a helically extending conductor or wire 14 about the core. A layer 16 of fiberglass overlies conductor or wire 14, with an additional layer 18 of silicone or other flexible material forming an outer jacket of cable 10.

While cables of this construction can be extremely versatile in response to unique heating requirements, there are problems associated with providing an electrical termination to an end of the cable. In order to provide an electrical termination to an end of the cable, a sufficient length of the helically extending wire adjacent to the cable end must be exposed. This is a challenging task. The electrically resistive wire is extremely small, typically ranging from about 0.002 to 0.010 inch in diameter, so that conventional methods of exposing conductors in cables, i.e., stripping the outer layer (s) such as by cutting the layers, risk severely damaging, if not completely severing the wire, rending the cable useless for its intended application.

What is needed is a device that can easily and reliably provide an electrical termination for cables having electrically resistive wires for providing electrical resistance heating, without damaging the wires.

SUMMARY OF THE INVENTION

The present invention relates to a device for use with providing an electrical termination to an end of a cable having a conductor helically disposed between a core and a layer overlying the core. The device includes a body having an opening sized greater than a diameter defined by the helically disposed conductor but less than a diameter of the layer. As a result of the end of the cable being sufficiently inserted through the opening from one side of the body, the helically disposed conductor is exposed about a length of cable extending through another side of the body.

The present invention further relates to an electrical connector for use with providing an electrical termination to an end of a cable having a conductor helically disposed between a core and a layer overlying the core. The connector includes a first portion having an opening sized greater than a diameter defined by the helically disposed conductor but less than a diameter of the layer. A second portion has an opening sized greater than a diameter defined by the helically disposed conductor. A third portion is configured to receive a conductor of a second cable. As a result of the end of the cable being sufficiently inserted through the opening of the first portion, the helically disposed conductor is exposed about a length of the cable extending through another side of the first portion and received in the opening of the second portion.

The present invention still further relates to a method of providing an electrical termination to an end of a cable having a conductor helically disposed between a core and a layer overlying the core. The method includes providing the cable and providing a body having an opening sized greater than a diameter defined by the helically disposed conductor but less than a diameter of the layer. The method further includes sufficiently inserting the end of the cable through the opening from one side of the body to expose the helically disposed conductor about a length of the cable extending through another side of the body. The method further includes forming the electrical termination over the exposed conductor.

An advantage of the present invention is that the electrical connector is of unitary construction.

A further advantage of the present invention is that the body does not require removing a portion of an outer layer(s) of a cable having a conductor disposed beneath the outer layer to form an electrical termination between the body and the conductor.

A still further advantage of the present invention is that an electrical connector does not require removing an outer layer (s) of a cable having a conductor disposed beneath the outer layer to form an electrical termination between the connector and the conductor.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Referring to FIGS. 3, 4, 6, 8 are embodiments of devices 21 or connectors 50, 150 according to the present invention for use with providing an electrical termination to an end of a heater cable or cable 10.

Figure 1:
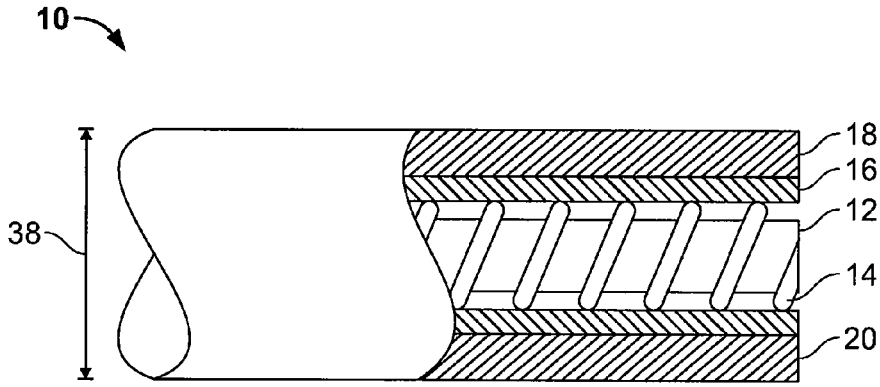
FIG. 1 (Prior Art)
FIG. 1 is a partial cross sectional and cutaway view of a prior art heater cable.
Figure 2:
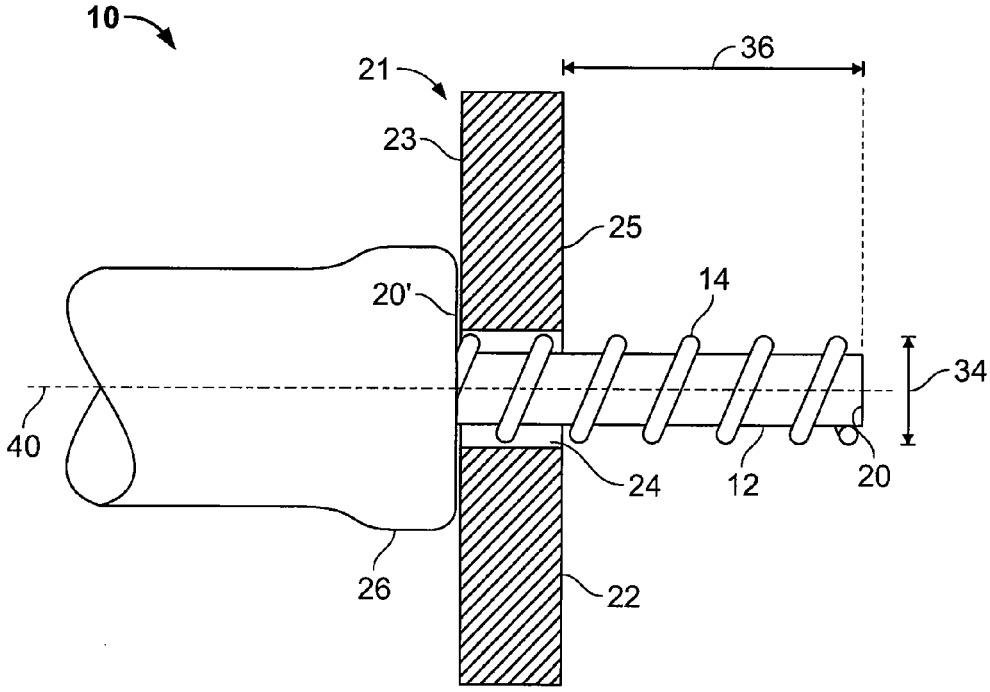
FIG. 2 is a partial cross sectional view of an embodiment of a device of the present invention for providing an electrical termination to an end of a heater cable.

As shown in FIG. 2, end 20 of cable 10 is brought into alignment with opening 24 of device 21 and directed into abutting contact with a side or surface 23 of device 21. Opening 24 is sized greater than a diameter 34 defined by the helically disposed conductor or wire 14, but less than a diameter 38 of layer 18 (FIG. 1). Diameter 34 refers to the sum of the diameter of core 12 and twice the diameter of conductor or wire 14. The size of opening 24 corresponds at least in part to the ability of layers 16, 18 of cable 10 to slide with respect to each other and the thickness of layers 16, 18. In other words, opening 24 can be larger than the outer diameter of layer 16, if layers 16, 18 of cable 10 adjacent to end 20 of cable 10 do not easily slide with respect to each other in response to layer 18 being moved away from end 20 by a force applied to end 20 of layer 18 that is substantially parallel to a central axis 40 of cable 10. The force is the axial force applied to end 20 of layer 18 by surface 23 of device 21.

Upon application of sufficient force to end 20 of layer 18 or layers 16, 18 by surface 23 that is substantially parallel to axis 40, core 12 and helically disposed conductor or wire 14 are directed through opening 24 until end 20 of core 12 and helically disposed wire 14 extends a distance 36 from a surface 25 of device 21. In one embodiment, layers 16, 18 are substantially prevented from extending through opening 24, the ends of layers 16, 18 represented as altered end position or altered end 20'. A compressed portion 26 consisting of layers 16, 18 is disposed adjacent to surface 23 of device 21 as a result of being substantially prevented from accessing opening 24. The portion of core 12 and helically disposed wire 14 corresponding to distance 36 are exposed, i.e., accessible from the exterior, due to layers 16, 18 being "peeled back" along the length of cable 10. Distance 36 is a distance sufficient to easily and reliably provide an electrical termination to end 20 of cable 10 over helically disposed conductor or wire 14 without having to strip away layers 16, 18, such as by cutting, which can damage the wire.

Figure 3:
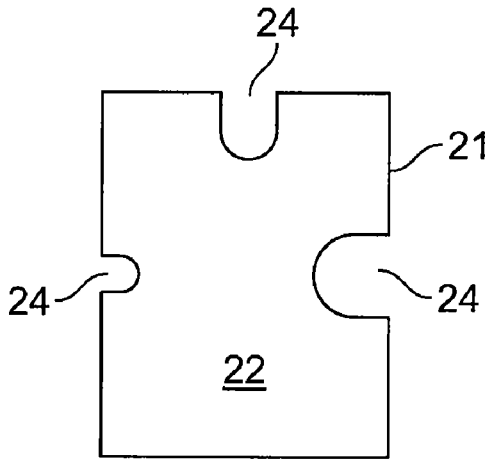
FIG. 3 is an elevation view of an embodiment of a device of the present invention for providing an electrical termination to an end of a heater cable.
Figure 4:
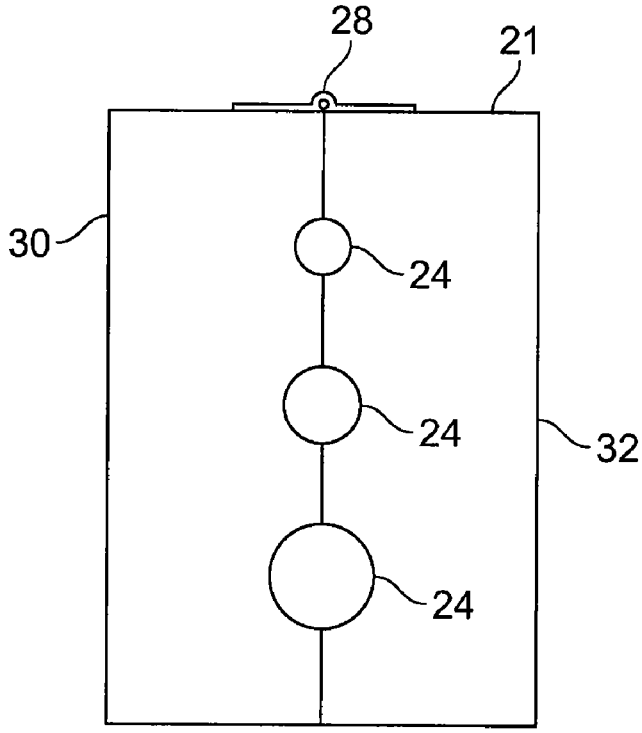
FIG. 4 is an elevation view of a further embodiment of a device of the present invention for providing an electrical termination to an end of a heater cable.

FIGS. 3-4 show different embodiments of device 21. FIG. 3 shows an embodiment in which device 21 comprises a body 22 having an opening 24 or a plurality of differently sized openings 24 disposed along the periphery of the body. In other words, opening 24 does not form a closed geometry and permits body 22 to be disengaged from cable 10 after an electrical termination has been provided. In other words, the opening is configured for separation of the body 22 from cable 10 after termination of the cable. However, by virtue of the open geometry of opening 24, it is not possible for device 21 to apply a force along the entire periphery of a corresponding cable layer in an attempt to provide an electrical termination as described above. Alternately, as shown in FIG. 4, device 21 includes multiple body portions 30, 32 that are selectably separable, such as by a hinge 28. As shown, each opening 24 is partially formed along the periphery of each device portion 30, 32, the opening portion having a corresponding opening portion in the other device portion when the device portions are rotatably brought together about the hinge 28. Each opening 24 is of closed geometry so that is possible to apply a force along the entire periphery of a corresponding cable layer in an attempt to provide an electrical termination as described above.

It is to be understood that opening 24 does not necessarily have a uniform cross sectional area, and can include protrusions or discontinuities along or adjacent to the surface of the opening. Opening 24 can also include other geometric features that will help sufficiently retain the outer layer or layers of the cable from the end of the cable to expose the helically disposed wire about a length of the cable to provide an electrical termination to the helically disposed portion. It is to be further understood that retaining the outer layer or layers of the cable does not necessarily prevent the outer layer or layers from extending through opening 24 from one surface to another surface of device 21 or connectors 50, 150 (FIGS. 5 and 8, respectively), but does sufficiently restrict the position of altered end 20' of outer layer or layers with respect to the position of end 20 of wire 14 and core 12 so that the exposed distance 36 of wire 14 is sufficient to provide an electrical termination providing sufficient electrical contact between the terminating connector and wire 14.

Figure 5:
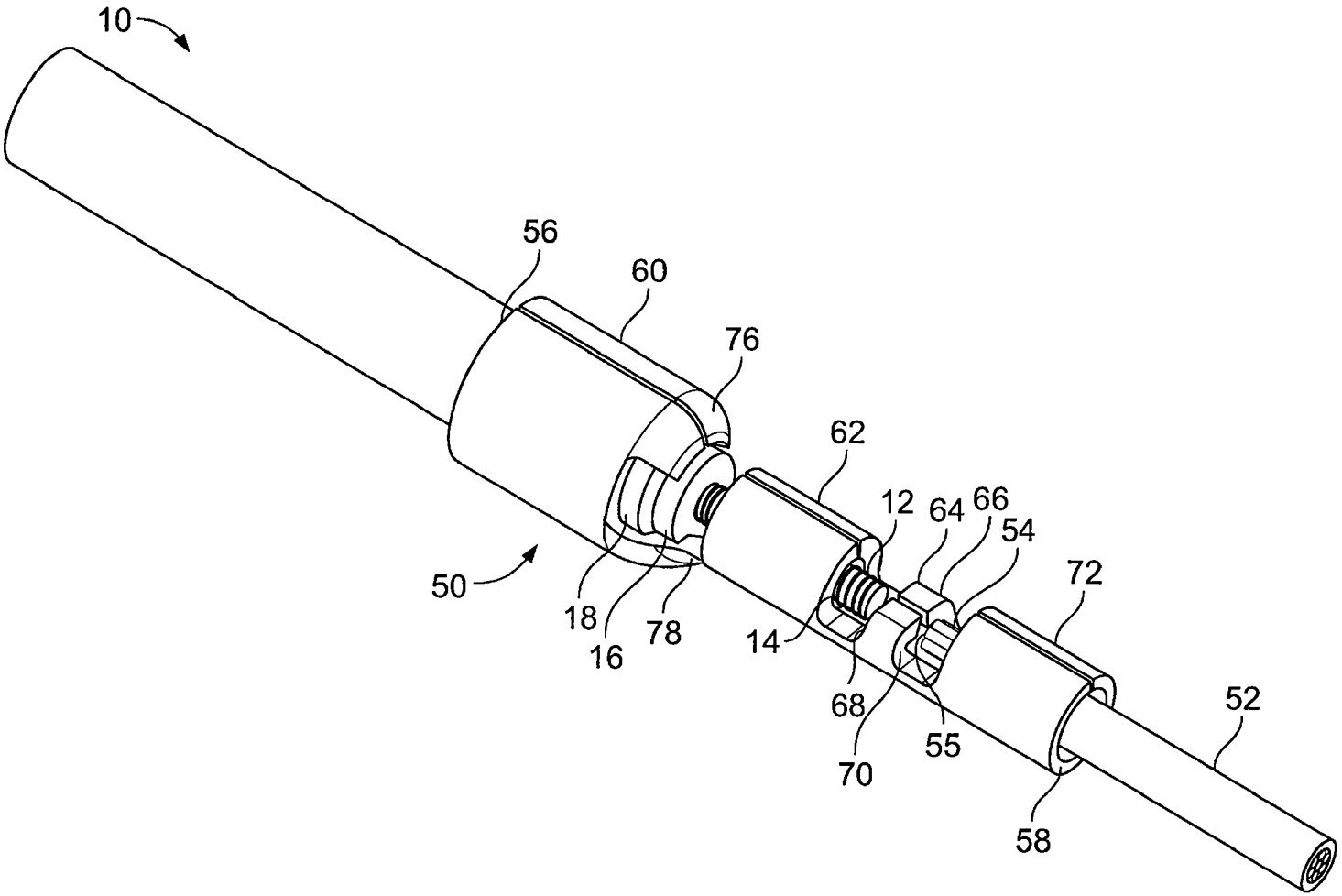
FIG. 5 is a top perspective view of an embodiment of a connector of the present invention for providing an electrical termination to an end of a heater cable, further showing the heater cable and corresponding electrical cable.
Figure 6:
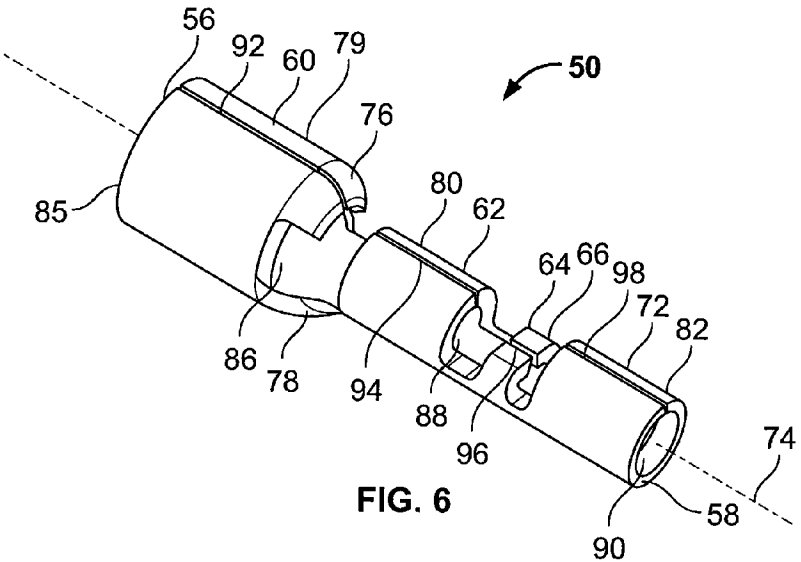
FIG. 6 is a top perspective view of the connector of FIG. 5.
Figure 7:
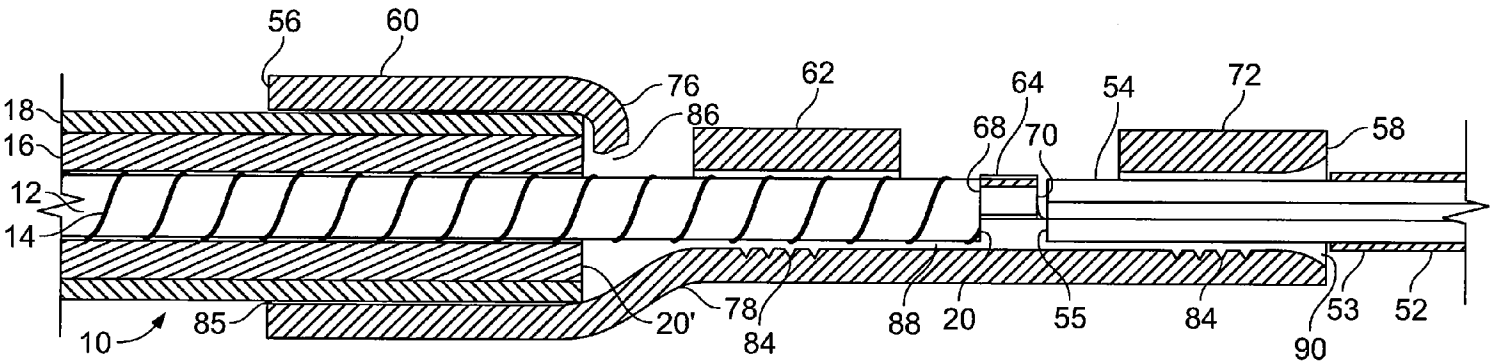
FIG. 7 is a partial cross sectional and cutaway view of the connector, heater cable and corresponding electrical cable of FIG. 5.

FIGS. 5-7 show a device embodiment wherein the device used to provide the electrical termination is also an electrical connector 50 that is also assembled to wire 14 to establish the electrical contact with wire 14. Connector 50 includes a first portion 60 having an end 56 for receiving end 20 of cable 10. First portion 60 has an opening 85 disposed adjacent to end 56 sized greater than a diameter defined by layer 18, or the outer layer of cable 10 so that end 20 can be directed inside opening 85. As shown in the figures, first portion 60 includes opposed retainers 79 that converge along a fold line 92 capable of receiving layer 18, or at least partially receiving layer 18. Alternately, retainer 79 could comprise a single component that substantially defines first portion 60. While opening 85 adjacent to end 56 has a diameter greater than layer 18, the size of opening 85 proceeding toward opening 86 is not necessarily of uniform cross sectional area, and can include protrusions or discontinuities along or adjacent to the surface of the opening 85 toward opening 86. Opening 85 can also include other geometric features that will help sufficiently retain the outer layer or layers of the cable from the end of the cable to expose the helically disposed wire about a length of the cable to provide an electrical termination to the helically disposed portion.

Proceeding along first portion 60 from end 56 toward opening 86, retainers 79 extend to a lip 76 extending radially inwardly toward center axis 74 (FIG. 6). As shown in FIG. 7, opposite lip 76, retainers 79 include a curved, gradual inwardly directed portion 78. Thus, opening 86 of first portion 60 is at least partially defined by lip 76 and inwardly directed portion 78, which opening 86 being sized greater than a diameter 34 (FIG. 2) defined by the helically disposed conductor or wire 14, but less than a diameter of the outer layer 18. While inwardly directed portion 78 decreases the size of opening 86, inwardly directed portion 78 is sized in one embodiment to substantially correspond to the collective thicknesses of layers 16, 18 so that the center axis 40 (FIG. 2) of cable 10 is substantially coincident with axis 74 of connector 50 as cable 10 is inserted in connector 50. Stated differently, as cable 10 is further inserted inside opening 85 and layers 16, 18 are substantially prevented from extending through opening 86 due to lip 76 and inwardly directed portion 78, center axis 40 of exposed helically disposed wire 14 and core 12 extending through opening 86 are maintained in substantial centered alignment with respect to axis 74 inside second portion 62.

Second portion 62, as shown, includes opposed retainers 80 that converge along a fold line 94 and having an opening 88 sized greater than diameter 34 (FIG. 2) defined by the helically disposed conductor or wire 14 and core 12. Alternately, retainer 80 could comprise a single component that substantially defines second portion 62. In one embodiment, second portion 62 includes a plurality of grooves 84 formed substantially perpendicular to axis 74 to help secure wire 14 and core 12 extending through second portion 62, once the size of opening 88 of second portion 62 is sufficiently reduced, such as by crimping with a conventional crimping tool (not shown). It is to be understood that grooves 84 can be disposed at an angle to axis 74. However, prior to crimping, it is typically desirable to further insert wire 14 and core 12 until end 20 abuts a surface 68 of stop 64. In one embodiment, stop 64 includes opposed retainers 66 that are brought together along a fold line 96. Alternately, retainer 66 could comprise a single component that substantially defines stop 64.

As shown in FIGS. 5-7, opposite stop 64 further proceeding along axis 74 of connector 50 toward end 58, a third portion 72 is provided to receive a conductor 54, or as shown, multiple strand conductors 54 of a cable 52. In one embodiment, third portion 72 includes opposed retainers 82 that converge along a fold line 98 having an opening 90 sized greater than conductor 54. Alternately, retainer 82 could comprise a single component that substantially defines third portion 72. In one embodiment, third portion 72 includes a plurality of grooves 84 formed substantially perpendicular to axis 74 to help secure conductor 54 extending through third portion 72, once the size of opening 90 of third portion 72 is sufficiently reduced, such as by crimping with a conventional crimping tool. It is to be understood that grooves 84 can be disposed at an angle to axis 74. Cable 52 is typically a conventional electrical cable, including a layer 53 overlying conductor 54. In one embodiment, adjacent end 55 of cable 52, layer 53 is stripped and removed from cable 52, such as with a conventional wire stripping tool (not shown), exposing a length of conductor 54. End 55 of exposed conductor 54 is then inserted into opening 90 of third portion 72 at end 58 of connector 50 until end 55 abuts surface 70 of stop 64.

In one embodiment, connector 50 is composed of a tin-coated copper alloy in which fold lines 92, 94, 96, 98 of respective first portion 60, second portion 62, stop 64 and third portion 72 are brazed together to provide enhanced structural integrity. Following insertion of cables 10 and 52 as described above, the sizes of each of first portion 60, second portion 62 and third portion 72 are reduced, such as by crimping, to provide an electrical termination for both of cables 10 and 52. However, any suitable conductive material having sufficient material properties could also be used to construct connector 50, and brazing or other method of joining fold lines 92, 94, 96 98 may not be required.

It is to be understood that as shown, connector 50 is preferably of unitary construction, although any of the components of connector 50 could be separate components assembled together to form connector 50.

Figure 8:
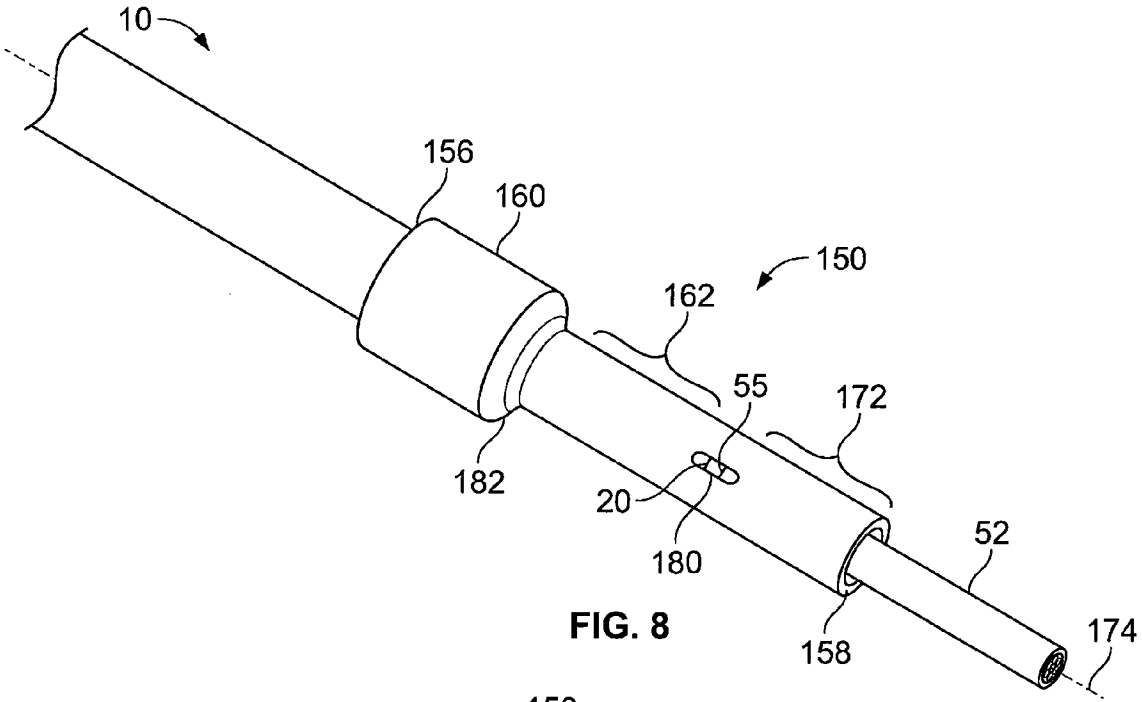
FIG. 8 is a top perspective view of a further embodiment of a connector of the present invention for providing an electrical termination to an end of a heater cable, further showing the heater cable and corresponding electrical cable.
Figure 9:
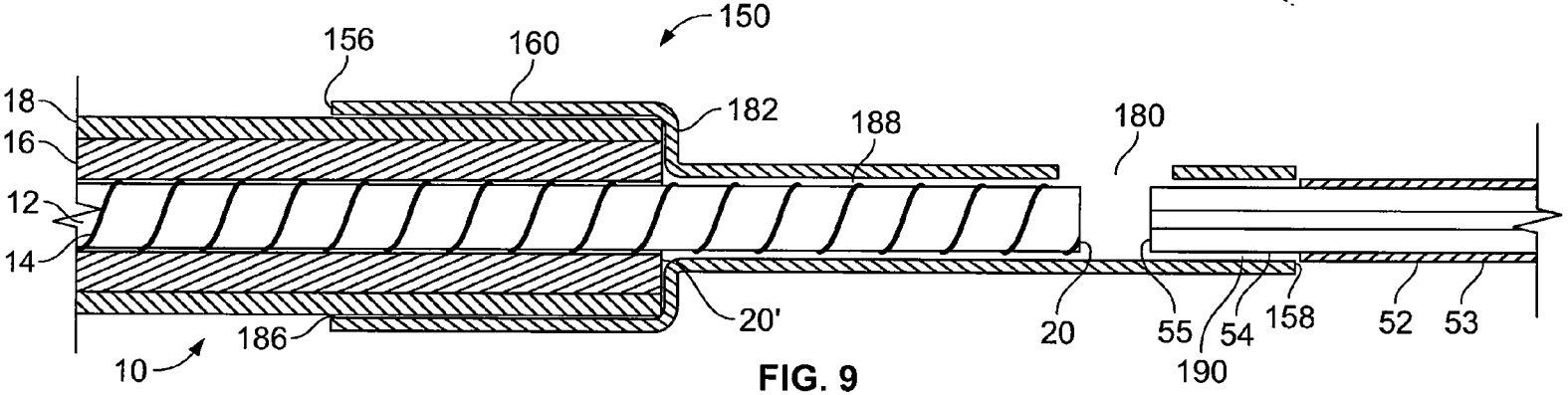
FIG. 9 is a partial cross sectional and cutaway view of the connector, heater cable and corresponding electrical cable of FIG. 5.

FIGS. 8-9 show an alternate embodiment of the connector of the present invention, which is identified as connector 150. Connector 150 defines a substantially closed construction, with the exception of opening 180, which provides a means to confirm that the cable conductors 14, 54 have been inserted to a sufficient depth prior to securing the conductors to the connector 150.

Connector 150 includes a first portion 160 having an end 156 for receiving end 20 of cable 10. First portion 160 has an opening 186 disposed adjacent to end 156 sized greater than a diameter defined by layer 18, or the outer layer of cable 10 so that end 20 can be directed inside opening 186. As shown in the figures, first portion 160 is capable of receiving layer 18, or at least partially receiving layer 18. While opening 186 adjacent to end 156 has a diameter greater than layer 18, the size of opening 186 is not necessarily of uniform cross sectional area, and can include protrusions or discontinuities along or adjacent to the surface of the opening 186. Opening 186 can also include other geometric features that will help sufficiently retain the outer layer or layers 16, 18 of the cable 10 from the end 20 of the cable to expose the helically disposed wire 14 about a length of the cable to provide an electrical termination to the helically disposed portion as previously discussed.

Proceeding along first portion 160 from end 156 toward opposite end 158, first portion 160 extends to an annular shoulder 182 further extending to a second portion 162 having an opening 188, which opening 188 being sized greater than a diameter 34 (FIG. 2) defined by the helically disposed conductor 14, but less than a diameter of the outer layers 16, 18. Annular shoulder 182 concentrically decreases the size of opening 186 to opening 188 between first portion 160 and second portion 162 to substantially correspond to the collective thicknesses of layers 16, 18 so that the center axis 40 (FIG. 1) of cable 10 is substantially maintained as cable 10 is inserted in connector 150. Stated differently, as cable 10 is further inserted inside opening 188 and layers 16, 18 are substantially prevented from extending through opening 188 due to shoulder 182, exposed helically disposed wire 14 and core 12 extending through opening 188 are maintained substantially centered with respect to axis 174 inside second portion 162.

Second portion 162, as shown, has an opening 188 sized greater than diameter 34 (FIG. 2) defined by the helically disposed conductor 14 and core 12. In one embodiment, second portion 62 includes a plurality of grooves (not shown), similar to grooves 84 (FIG. 7) formed substantially perpendicular to axis 174 to help secure wire 14 and core 12 extending through second portion 162, once the size of opening 188 of second portion 162 is sufficiently reduced, such as by crimping with a conventional crimping tool. However, prior to crimping, it is desirable to sufficiently insert wire 14 and core 12 inside of opening 188 to ensure a proper termination is achieved. Window 180 serves as a visual indicator to ensure wire 14 and core 12 have been sufficiently inserted inside opening 188 prior to achieving termination.

As further shown in FIGS. 8-9, further proceeding along axis 174 of connector 150 from end 156 toward end 158 past window 180, a third portion 172 is provided to receive conductor 54, or as shown, multiple strand conductors 54 of cable 52. In one embodiment, third portion 172 includes a plurality of grooves, similar to grooves 84 (FIG. 7) formed substantially perpendicular to axis 174 to help secure conductor 54 extending through third portion 172, once the size of opening 190 of third portion 172 is sufficiently reduced, such as by crimping with a conventional crimping tool. Cable 52 is typically a conventional electrical cable, including a layer 53 overlying conductor 54. In one embodiment, adjacent end 55 of cable 52, a portion of layer 53 is stripped and removed from cable 52, such as with a conventional wire stripping tool (not shown), exposing a length of conductor 54. In one embodiment, end 55 of exposed conductor 54 is then inserted into opening 190 of third portion 172 at end 158 of connector 150 until end 55 can be viewed from window 180.

In one embodiment, connector 150 is composed of a tin-coated copper alloy in which fold lines (not shown) of respective first portion 160, second portion 162 and third portion 172 are brazed together. Following insertion of cables 10 and 52 as described above, the sizes of each of first portion 160, second portion 162 and third portion 172 are reduced, such as by crimping, to provide an electrical termination for both of cables 10 and 52. However, any suitable conductive material having sufficient material properties could also be used to construct connector 150, and brazing or other method of joining the fold lines may not be required.

It is to be understood that as shown, connector 150 is of unitary construction, although any of the components of connector 150 could be separate components assembled together to form connector 150.

It is to be understood that an embodiment of connector can provide an electrical termination for a pair of cables having a helically disposed conductor. Such an embodiment could include a fourth portion (not shown), wherein the third and fourth portions are substantially similar to the first and second portions, as previously discussed. In other words the fourth portion would secure the outer layers of the second cable similar to the outer layers of the first cable as previously discussed.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector for use with providing an electrical termination to an end of a cable having a conductor helically disposed between a core and a layer overlying the core, the connector comprising:

a cylindrical first portion having a first opening at one end of the first portion, the first opening being sized greater than the diameter of the layer, a second opening at an opposite end of the first portion, the second opening being sized greater than a diameter of the core and the helically disposed conductor but less than a diameter of the layer;

a cylindrical second portion having an opening sized greater than a diameter of the core and the helically disposed conductor;

wherein as a result of the end of the cable being inserted through the first opening of the first portion and through the second opening of the first portion, the layer is prevented from extending through the second opening thereby allowing the core and the helically disposed conductor to be exposed and positioned in the opening of the second portion without the need to cut and strip the layer from the helically disposed conductor.

2. The electrical connector of claim 1, wherein the connector is of unitary construction.

3. The device of claim 1, wherein the first portion is configured to receive at least a portion of the layer.

4. The device of claim 1, wherein the first and second portions are crimp-type portions.

5. A method of providing an electrical termination to an end of a cable having a conductor helically disposed between a core and a layer overlying the core, the steps comprising:

providing the cable;

providing a connector body with a cylindrical portion for receiving the cable therethrough, the cylindrical portion having an opening sized greater than a diameter of the core and the helically disposed conductor but less than a diameter of the layer;

inserting the end of the cable through the opening from one side of the connector body, the opening preventing the layer from being inserted through the opening, thereby exposing the core and the helically disposed conductor about a length of the cable extending through another side of the connector body, such that the layer is removed from the core and the helically disposed conductor without the need to cut and strip the layer from the helically disposed conductor; and forming the electrical termination over the exposed conductor.

6. The method of claim 5, wherein the step of providing a body includes providing an electrical connector, the electrical connector comprising:

a first portion having an opening sized greater than a diameter defined by the helically disposed conductor but less than a diameter of the layer;

a second portion having an opening sized greater than a diameter defined by the helically disposed conductor; and a third portion configured to receive a conductor of a second cable.

7. The method of claim 6, wherein the step of forming the electrical termination includes securing the second portion to the helically disposed conductor.

8. The method of claim 7, wherein the step of forming the electrical termination includes securing the first portion to at least a portion of the layer.

9. The method of claim 5, wherein the second portion is secured to the helically disposed conductor by crimping.

* * * * *